United States Patent [19]

Robertson

[11] 4,134,155

[45] Jan. 16, 1979

[54] SWIMMER PROTECTIVE HELMET

[75] Inventor: Douglas G. Robertson, Oxnard, Calif.

[73] Assignee: The United States of America as represented by the Secretary of the Navy, Washington, D.C.

[21] Appl. No.: 615,264

[22] Filed: Sep. 22, 1975

[51] Int. Cl.[2] ..... A42B 3/02

[52] U.S. Cl. ..... 2/412; 2/6; 2/7

[58] Field of Search ..... 2/3 R, 6, 7, 200, 192, 2/68, 411, 412, 410

[56] References Cited

U.S. PATENT DOCUMENTS

| | | | |
|---|---|---|---|
| 296,438 | 4/1884 | Newton, Jr. | 2/7 |
| 2,709,667 | 5/1955 | Grubb | 2/5 X |
| 2,869,133 | 1/1959 | Garbellano | 2/68 |
| 2,893,014 | 7/1959 | Mabry | 2/7 X |
| 2,926,356 | 3/1960 | Taylor | 2/3 R |
| 3,274,612 | 9/1966 | Merriam | 2/68 |
| 3,296,582 | 1/1967 | Ide | 2/68 X |
| 3,479,666 | 11/1969 | Webb | 2/3 R |
| 3,686,689 | 8/1972 | Berlinski | 2/68 X |
| 3,885,246 | 5/1975 | Tung | 2/3 R |

*Primary Examiner*—Peter Nerbun

*Attorney, Agent, or Firm*—Richard S. Sciascia; Joseph M. St.Amand; William W. Cochran

[57] ABSTRACT

A swimmer protective helmet designed to protect the cranium of a swimmer from impacts with hard or sharp surfaces, thereby preventing lacerations and concussions of the skull or other physical disablement arising from being struck on the head while engaged in activities on the surface, underwater, or while taking entry into or leaving a body of water. The protective helmet is particularly designed to prevent injuries while engaging in search and rescue operations during over water flights, in helicopters wherein an air crewman may be required to descend from a helicopter either by free jump or by rescue hoist to the water's surface to aid in recovery of an injured or disabled survivor and subsequently re-enter the hovering helicopter.

20 Claims, 4 Drawing Figures

SWIMMER PROTECTIVE HELMET

BACKGROUND OF THE INVENTION

The present invention pertains generally to helmets, and more specifically to swimmer protective headgear. Normally, the most physically hazardous helicopter missions are those involving combat search and rescue wherein maximum speed of operation and mobility of the aircrew are required. Various hazards are present in over water operations when a helicopter cannot descend to the surface of the water to affect pickup of the survivor. In the case where a survivor is wounded, in shock, or otherwise disabled and cannot help himself, an air crewman must descend from the helicopter to the water to aid in his recovery. Prior to exiting the helicopter, the recovery air crewman must discard his protective flight helmet since its construction poses a liability to his visability, mobility and successful rescue. Consequently, he must enter the water bareheaded, wearing a scuba wetsuit or an inflatable anti-exposure suit. The air crewman is required to either free jump from a hover altitude of as much as 40 feet or, if the conditions permit, ride the rescue hoist down to the water surface. In addition, a substantial amount of equipment, such as a rescue sling, net or hoist, flotation device or flotation litter must also be transferred to the water surface.

Chances of head injury are therefore substantial in all phases of the rescue operation since the rescue air crewman is not provided with a suitably protective helmet. Conventional headgear has been found to be unsuitably heavy, causing injury during free jump and has also been found to retain water, thereby decreasing the swimmer's mobility. Additionally, conventional headgear has either not provided impact protection or, if so, has been designed to be so bulky as to obscure vision without sufficient thermal protection to a swimmer descending in cold waters. Moreover, immersion in water of conventional flight helmets would cause extensive damage to electronic components mounted therein, thereby ruling out their use as protective helmets.

SUMMARY OF THE INVENTION

The present invention overcomes the disadvantages and limitations of the prior art by providing an improved swimmer protective helmet. More particularly, the present invention provides a helmet which is impact-protective and thermal protective having a continuous inner open cell foam liner which is specifically pervious to the air and water. The foam liner is positioned in intimate contact with the wearer's head and is covered by a closed cell foam impact cushioning layer having indented portions in which separate, rigid, impact deflecting plates are placed, covered by an outer overall covering having the characteristics of high temperature fire protection and detection aiding or camouflage.

It is therefore an object of the present invention to provide an improved swimmer protective helmet.

It is also an object of the present invention to provide a swimmer protective helmet which is impact protective.

Another object of the present invention is to provide a swimmer protective helmet which is thermally protective.

Another object of the present invention is to provide a helmet having a low profile for unobscured visibility and unrestricted mobility.

Another object of the present invention is to provide a swimmer protective helmet which is high temperature and fire resistant.

Another object of the present invention is to provide a swimmer protective helmet for detecting aiding and rescue missions.

Other objects and further scope of applicability of the present invention will become apparent from the detailed description given hereinafter. The detailed description indicates the preferred embodiment of the invention and is given only by way of illustration since various changes and modifications within the spirit and scope of the invention will become apparent to those skilled in the art from this detailed description. The foregoing abstract of the disclosure is for the purpose of providing a non-legal brief statement to serve as a search and scanning tool for scientists, engineers, researchers and is not intended to limit the scope of the invention as disclosed herein, nor is it intended that it should be used in interpreting or in any way limiting the scope or fair meaning of the appended claims.

DETAILED DESCRIPTION OF THE PREFERRED EMBODIMENT

Figure 1:
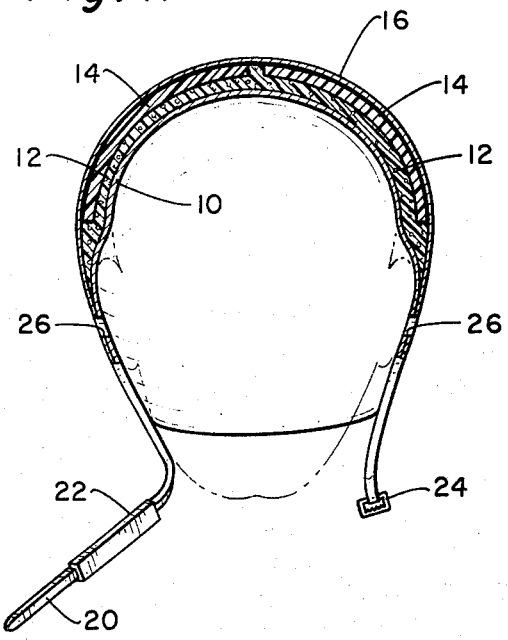
FIG. 1 is a front cutaway view of the preferred embodiment of the invention.

The swimmer protective helmet comprising the preferred embodiment of the invention consists of an open cell foam, e.g., sponge rubber, scuba type style hood 10, as shown in FIG. 1, covered with a closed cell foam, e.g., Ensolite foam, protective cushion pad 12 that is indented slightly in the process of manufacture to stabilize the position of suitably dimensioned, rigid, impact protective plates 14. The impact protective plates 14 can be constructed of either a fiberglass reinforced plastic plate formed in a sheet approximately 90/000ths of an inch thick or of a honeycomb material called Kevlar in a sheet of about 60/000ths of an inch thick. The entire helmet is then covered with a high temperature fire-resistant material 16, such as Nomex, Kynol, or Polybenzimidazole (PBI). A chin strap 20 is provided with a chin pad 22 and a closure device 24 to accommodate a range of adjustment for retention of the helmet on a swimmer's head. A suitably positioned vent 26 over each ear allows for unimpaired swimmer hearing out of water and allows easier pressure equalization of tympanic membranes during descent or ascent. The vent 26 also reduces the drumming noise of the hood over the ears in wave turbulence or while swimming.

Figure 2:
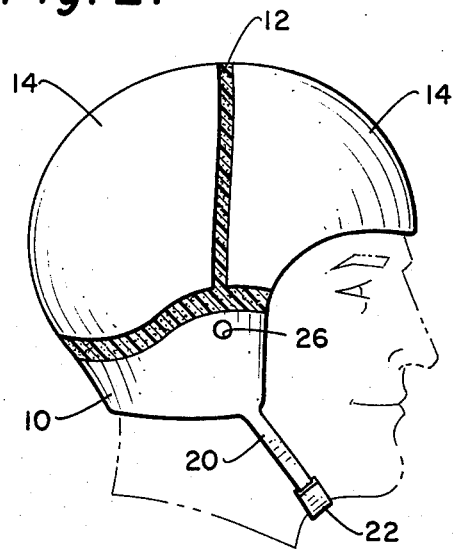
FIG. 2 is a side view of the inner portion of the preferred embodiment of the invention.

FIG. 2 shows a side view of the swimmer protective helmet as it appears without the outer overall covering layer 16. As shown in FIG. 2, the rigid impact deflecting plates 14 are sectioned on the swimmer's head and adhesively secured to the closed cell, foam impact cushioning layer 12. The cushioning layer and the foam liner to which the cushioning layer is secured are both elasticized materials. The rigid, impact deflecting plates 14 are secured to the cushioning layer in sections to allow for a tight fitting helmet having a low profile. Plates 14 are designed in a family of plates of about four to six different sizes for each segment to allow for even better fitting on the swimmer's head. In selecting a helmet for any particular swimmer, the desired rigid, impact deflecting plates may be selected by placing them directly against the swimmer's head to obtain the most suitable series of plates for that particular swimmer and then assembling them within the helmet.

Figure 3:
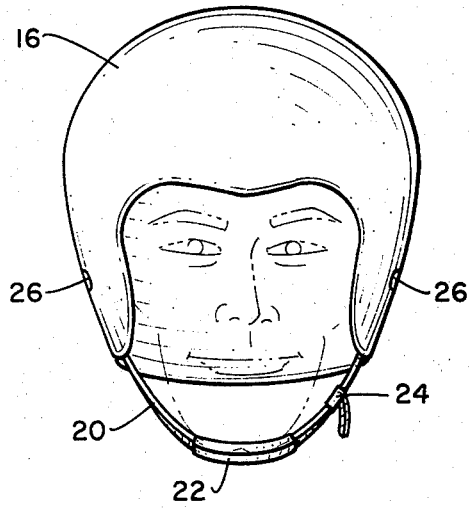
FIG. 3 is a front view of the preferred embodiment of the invention.
Figure 4:
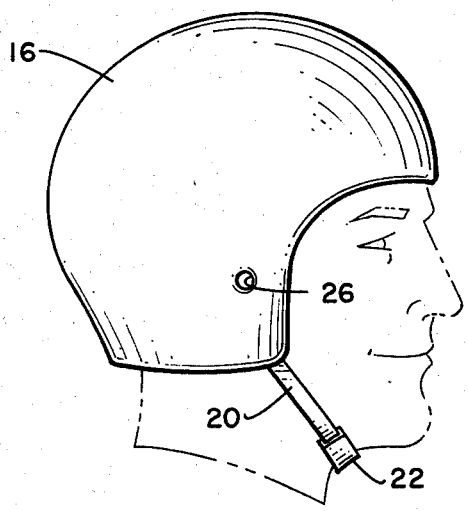
FIG. 4 is a side view of the preferred embodiment of the invention.

As shown in FIGS. 3 and 4, the outer overall covering layer 16 is positioned over the laminant layers 10, 12 and 14 and adhesively secured thereto. The cover 16 gives protection from burning oil or fuel on the surface of the water, and may be either camouflaged or made visible by reflective tape, fluorescent materials, or other highly reflective materials, or infrared sensitive for detection enhancement, depending upon the particular mission for which the helmet is to be used. Construction of the helmet provides a smooth, low profile assembly of the respective protective components in a flexible, lightweight, positive buoyancy helmet that will not shift on the head nor interfere with vision, hearing or mobility. It provides for a wide range of head sizes in an inexpensive manner without the necessity of custom molding of the protective plates for each individual wearer. It has the advantage of offering impact protection and high temperature fire protection while not impairing buoyancy, vision, hearing or mobility in the water. The open cell foam layer 10 provides thermal protection of the wearer in cold waters while the closed cell foam impact cushioning layer 12 provides cushioning and form fitting between the inner open cell foam liner 10 and rigid impact plates 14.

Obviously many modifications and variations of the present invention are possible in the light of the above teachings. It is therefore to be understood that within the scope of the appended claims the invention may be practiced otherwise than as specifically described.

What is claimed is:

1. A protective helmet for a swimmer's head comprising:

(a) a continuous inner, open cell foam liner which is pervious to both air and water, intimately in contact with said swimmer's head, providing a thermally protective layer for said swimmer's head;

(b) a closed cell foam impact cushioning layer having a concave and a convex surface, said concave surface being adhesively connected to said foam liner, said convex surface having a plurality of indentations formed therein;

(c) a plurality of rigid impact deflecting plates positioned within said indentations of said cushioning layer and secured thereto to form a substantially smooth outer surface; and (d) an outer overall covering layer positioned over said substantially smooth outer surface, said outer overall covering layer formed of a material which is resistant to high temperatures and fire;

(e) wherein said protective helmet is lightweight, flexible and has a low profile for unobscured vision and unrestrained mobility and has ear vents formed therein for unrestricted audition out of water and aural pressure equalization in water.

2. The protective helmet of claim 1 wherein said foam liner comprises a liner of sponge rubber.

3. The protective helmet of claim 1 wherein said cushioning layer comprises a layer of Ensolite foam.

4. The protective helmet of claim 1 wherein said outer overall covering layer comprises a layer of Nomex.

5. The protective helmet of claim 1 wherein said outer overall covering layer comprises a layer of Kynol.

6. The protective helmet of claim 1 wherein said outer overall covering layer comprises a layer of PBI.

7. The protective helmet of claim 1 wherein said outer overall covering has a camouflage coloration.

8. The protective helmet of claim 4 wherein said outer overall covering has a camouflage coloration.

9. The protective helmet of claim 5 wherein said outer overall covering has a camouflage coloration.

10. The protective helmet of claim 6 wherein said outer overall covering has a camouflage coloration.

11. The protective helmet of claim 1 wherein said outer overall covering is infrared sensitive for detection enhancement.

12. The protective helmet of claim 4 wherein said outer overall covering is infrared sensitive for detection enhancement.

13. The protective helmet of claim 5 wherein said outer overall covering is infrared sensitive for detection enhancement.

14. The protective helmet of claim 6 wherein said outer overall covering is infrared sensitive for detection enhancement.

15. The protective helmet of claim 1 wherein said plurality of rigid impact deflecting plates comprise plates of fiberglass.

16. The protective helmet of claim 1 wherein said plurality of rigid impact deflecting plates comprise plates of Kevlar.

17. The protective helmet of claim 1 wherein said plurality of rigid impact deflecting plates comprise a family of plates designed to fit various head sizes.

18. The protective helmet of claim 15 wherein said plurality of rigid impact deflecting plates comprise a family of plates designed to fit various head sizes.

19. The protective helmet of claim 16 wherein said plurality of rigid impact deflecting plates comprise a family of plates designed to fit various head sizes.

20. The protective helmet of claim 1 wherein said outer overall covering is highly reflective for detection enhancement.

* * * * *